US011015398B2

(12) United States Patent
Kristoffersen

(10) Patent No.: US 11,015,398 B2
(45) Date of Patent: May 25, 2021

(54) MARINE INSTALLATION

(71) Applicant: EQUINOR ENERGY AS, Stavanger (NO)

(72) Inventor: Steinar Kristoffersen, Kolsås (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 16/329,634

(22) PCT Filed: Jul. 5, 2017

(86) PCT No.: PCT/NO2017/050183
§ 371 (c)(1),
(2) Date: Feb. 28, 2019

(87) PCT Pub. No.: WO2018/044174
PCT Pub. Date: Mar. 8, 2018

(65) Prior Publication Data

US 2019/0195026 A1 Jun. 27, 2019

(30) Foreign Application Priority Data

Sep. 1, 2016 (GB) ..... 1614811

(51) Int. Cl.
*E21B 17/01* (2006.01)
*E21B 41/04* (2006.01)

(52) U.S. Cl.
CPC ..... *E21B 17/012* (2013.01); *E21B 17/01* (2013.01); *E21B 41/04* (2013.01)

(58) Field of Classification Search
CPC ..... E21B 17/012; E21B 17/01; E21B 41/04
USPC ..... 166/350
See application file for complete search history.

(56) References Cited

U.S. PATENT DOCUMENTS 3,823,680 A 7/1974 Straumsnes
5,069,580 A * 12/1991 Herwig ..... B63C 11/34 405/188
2007/0048093 A1 3/2007 Bhat et al.
2008/0253842 A1 10/2008 Wolbers et al.
2016/0060993 A1* 3/2016 Foster ..... E21B 41/0007 405/205

FOREIGN PATENT DOCUMENTS

EP 3 080 381 A1 10/2016
GB 2535716 A 8/2016
RU 2 139 219 C1 10/1999
(Continued)

OTHER PUBLICATIONS

International Search Report, issued in PCT/NO2017/050183, dated Sep. 4, 2017.
(Continued)

*Primary Examiner* — Matthew Troutman
*Assistant Examiner* — Patrick F Lambe
(74) *Attorney, Agent, or Firm* — Birch, Stewart, Kolasch & Birch, LLP

(57) ABSTRACT

A marine installation system for installing an item on a riser includes a cable extending between two supporting points, the cable being inclined relative to the horizontal; a first ROV arranged to mount the item on the cable at a first position; and a second ROV arranged to remove the item from the cable at a second position, and to install the item on the riser.

17 Claims, 4 Drawing Sheets

(56) References Cited

FOREIGN PATENT DOCUMENTS

| | | | |
|---|---|---|---|
| RU | 2 425 208 | C1 | 7/2011 |
| RU | 2 490 418 | C2 | 8/2013 |
| WO | WO 2012/168702 | A1 | 12/2012 |
| WO | WO 2015/088991 | A1 | 6/2015 |

OTHER PUBLICATIONS

United Kingdom Combined Search and Examination Report, issued in Priority Application No. 1614811.6, dated Jan. 31, 2017.
Written Opinion of the International Searching Authority, issued in PCT/NO2017/050183, dated Sep. 4, 2017.

* cited by examiner

MARINE INSTALLATION

FIELD OF THE INVENTION

The invention relates to a marine installation system and method for installing an item on a riser under the surface of the sea.

BACKGROUND OF THE INVENTION

It is known to use a vessel crane to deploy wear elements to working ROV(s) (Remotely Operated Vehicles). The vessel must be located close to the worksite to limit the need for flying elements from a vessel crane hook to the installation site.

A disadvantage of this arrangement is the need for full shutdown of all risers exposed to vessel impact from drift-off or drive-off.

As an alternative, it is known to locate a vessel outside of the area where risers are exposed to vessel impact from drift-off or drive-off, and fly in elements by ROV.

A disadvantage of this arrangement is the need to use an installation vessel with working ROVs on location for extremely long times, which is costly.

SUMMARY OF THE INVENTION

The invention provides a marine installation system and method as set out in the accompanying claims.

Preferred embodiments of the invention will now be described, by way of example only, with reference to the accompanying drawings.

DESCRIPTION OF PREFERRED EMBODIMENTS

Figure 1:
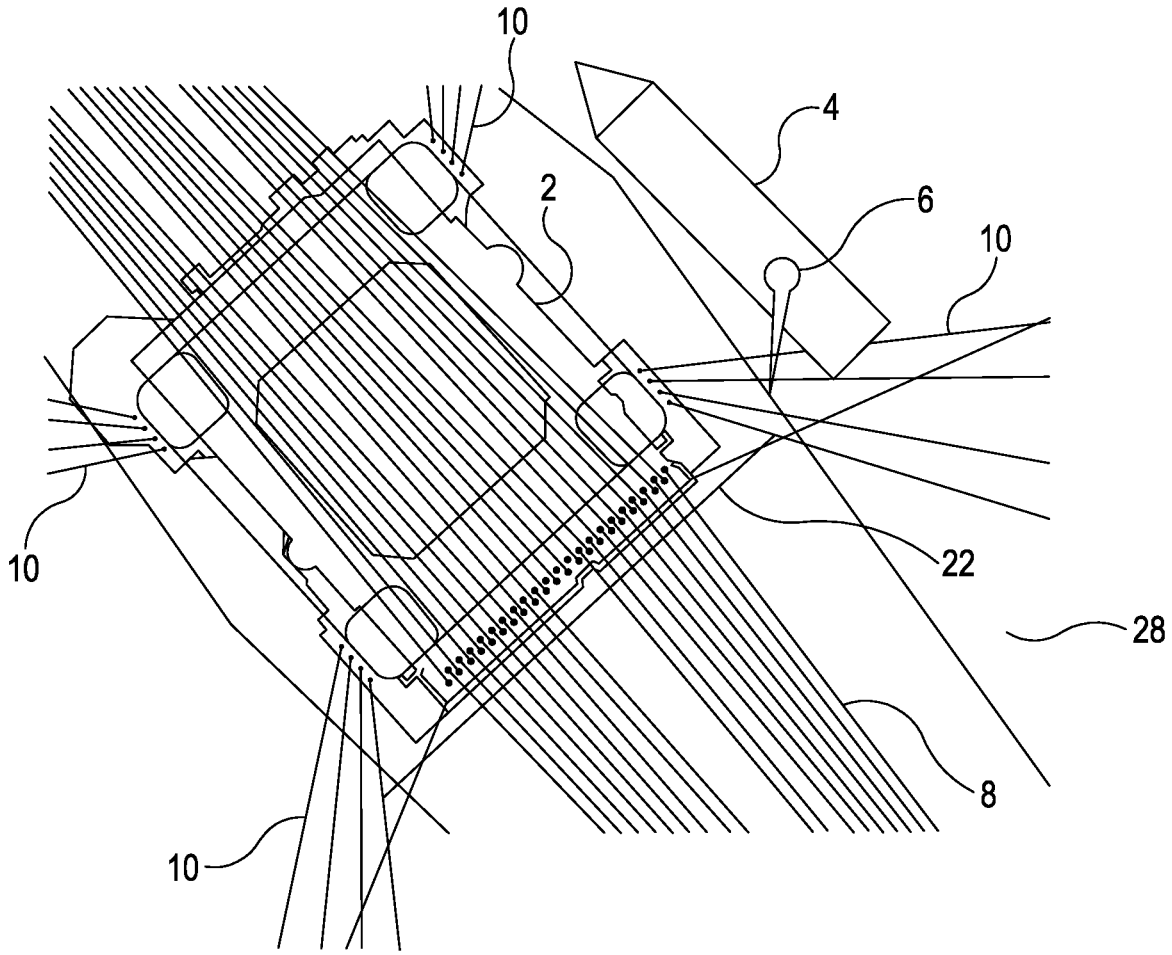
FIG. 1 shows a platform 2 on a sea.

FIG. 1 is a view of a platform 2 on a sea. An installation vessel 4 carrying a crane 6 is located beside the platform 2. The platform 2 supports a number of risers 8, which are tubes carrying e.g. hydrocarbons, such as oil and gas, and electricity and hydraulics, from the seabed (not shown) to the platform 2. The platform 2 is anchored to the seabed by a number of anchor chains 10.

Figure 2:
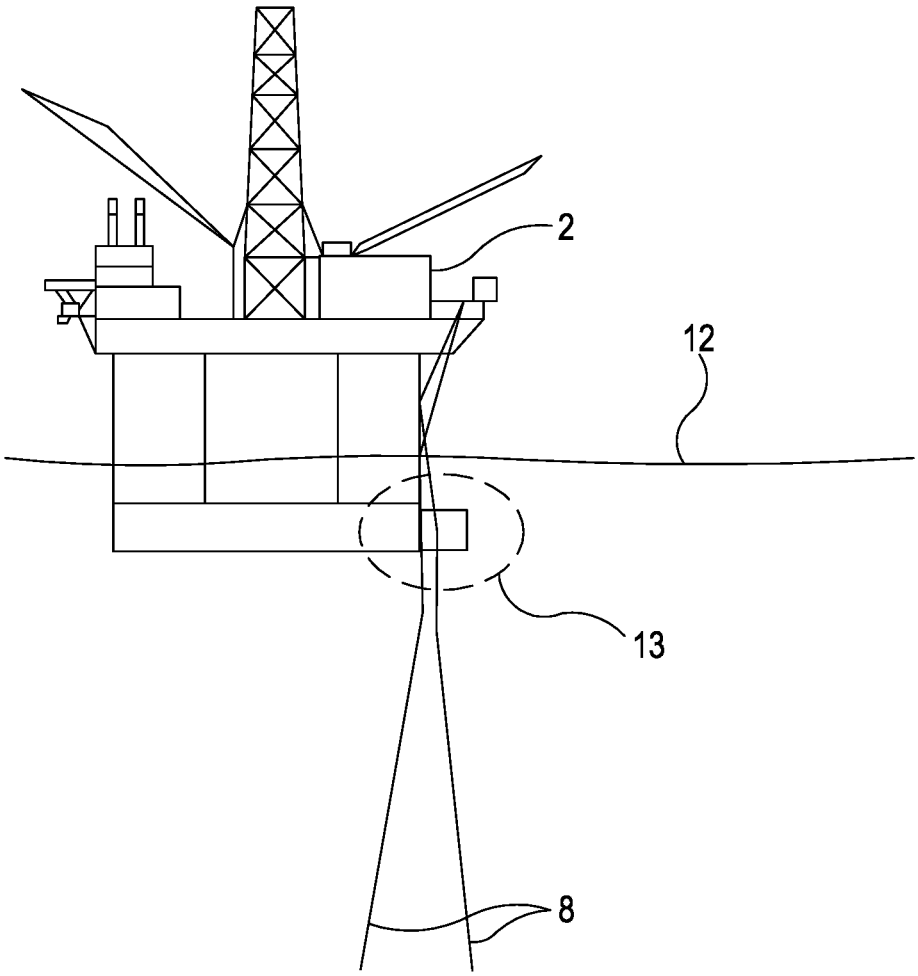
FIG. 2 is a side view of the platform.

FIG. 2 is a side view of the platform 2, which may be a floating platform. The sea surface 12 is shown, together with a region which we will call the ROV worksite 13. Two risers 8 are shown.

Figure 3:
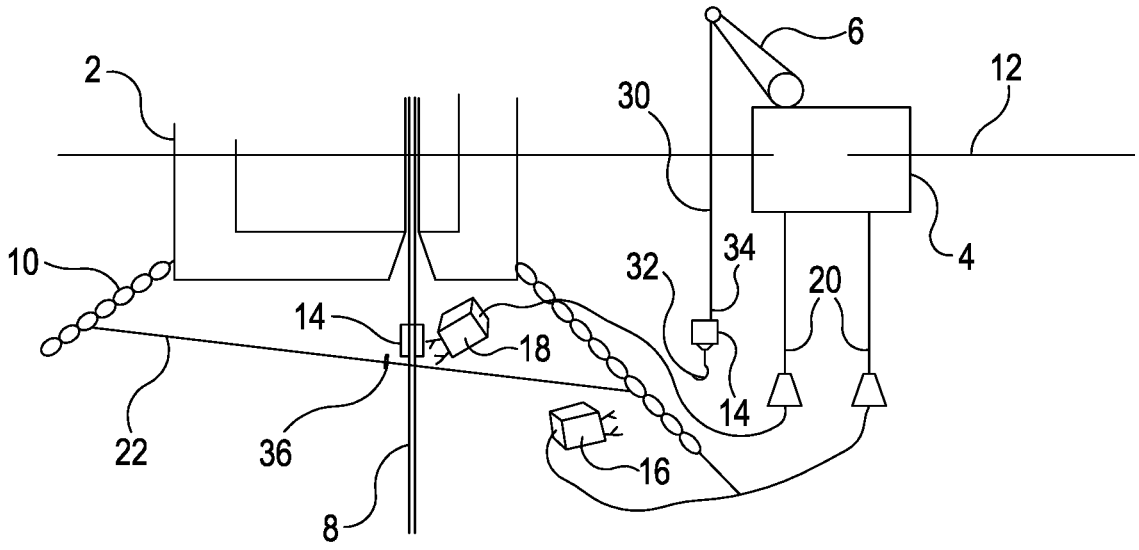
FIG. 3 shows a number of components below the sea surface.

FIG. 3 shows the platform 2 anchored by chains 10, and vessel 4 on the sea surface 12, and also shows a number of components below the sea surface 12 which are involved in a method of installing a wear element 14 onto one of the risers 8. The wear element is a cylindrical element, which is fitted around a riser 8 to prevent wear of the riser 8. First and second ROVs (Remotely Operated Vehicles) 16 and 18 are connected to the vessel 4 by umbilical cables 20.

As shown in FIG. 3, a transportation rope or cable 22 is fixed between two support points 24 and 26. The rope is fixed by ROV as a part of the preparations (preparatory work) for the marine campaign for the purpose of transporting wear elements. The support points 24, 26 may be provided by the anchor chains 10, for example. The cable 22 is inclined relative to the horizontal, to allow wear elements 14 to slide along the cable 22, either by sliding down the cable under the influence of gravity or by sliding up the cable as a result of buoyancy.

The transportation cable 22 is connected to an object outside of an area 28 where drift off, drive off, or other movement of the vessel 4 could expose the risers 8 to damage. This area 28 is indicated by shading in FIG. 1. The other end of the cable 22 is fixed to an object such that the tightened cable 22 will lead to or pass the ROV worksite 13 in the horizontal plane. The objects used to fix the cable 22 can for example be the anchor chains 10 or a purpose installed anchor (not shown). The height of the cable 22 relative to the ROV worksite 13 can be adjusted at either of the connection points 24 and 26 by rigging with either buoyancy elements to hoist up, or weight elements to lower, the path of the cable 22. The cable 22 has an inclination in the vertical plane to allow sliding of wear elements 14 along the cable 22 either by negative or positive submerged weight.

In a method of installing wear elements 14, the installation vessel 4 deploys a wear element 14 to the first ROV 16. This is done by lowering the wear element 14 from the crane 6 on a crane wire 30, as shown in FIG. 3. The first ROV 16 removes the wear element 14 from the crane wire 30. This is done by releasing the crane wire 30 from crane ROV rigging 34 (shown in FIG. 4) which is used to attach the wear element 14 to the crane wire 30. The first ROV 16 then attaches the wear element 14 to the transportation cable 22 using hook ROV rigging 32 (shown in FIG. 4) which is pre-installed on the wear element 14. The wear element 14 is then free to slide upwards or downwards along the transportation cable 22 dependent on buoyancy (negative or positive). The sliding movement of the wear element 14 is stopped by a pre-installed clamp or stopper 36.

Once the wear element 14 has been stopped by the stopper 36, the second ROV 18 releases the wear element 14 from the cable 22 and installs the wear element 14 as required on the riser 8. ROV rigging 32 and 34 used for transportation of the wear element 14 can then slide back along the cable 22, making use of negative or positive buoyancy, for later recovery, for example by the first ROV 16. In one embodiment, the wear element 14 together with its ROV rigging 32 and 34 has an overall density less than sea water, so that the wear element has positive buoyancy. This allows the wear element 14 and its ROV rigging 32 and 34 to slide upwards along transportation cable 22 from the first ROV 16 to the stopper 36, and then allows the ROV rigging 32 and 34 to slide back down the transportation cable 22 under the influence of gravity.

Figure 4:
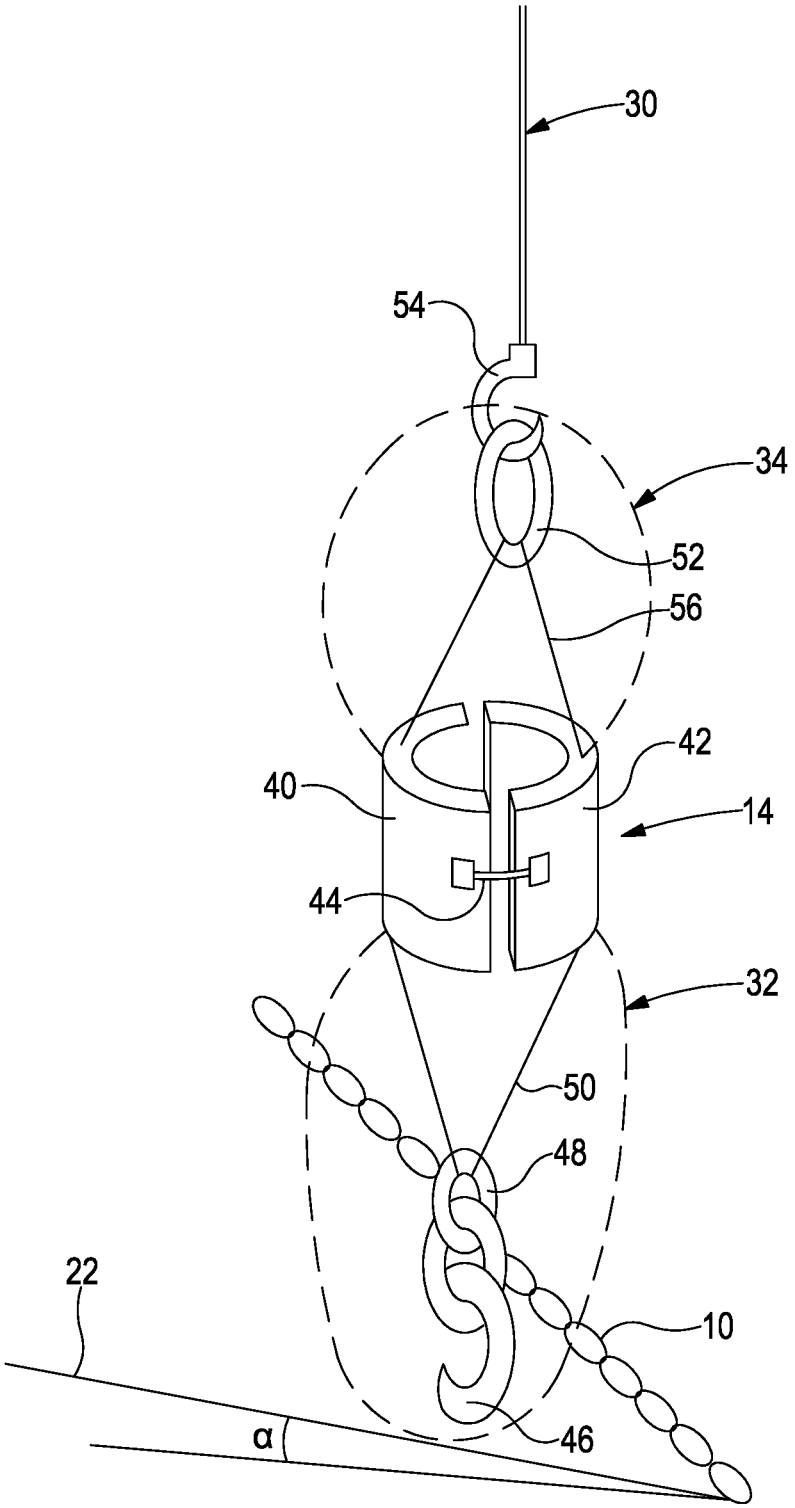
FIG. 4 shows a transportation cable attached to an anchor chain, and a wear element provided with rigging.

FIG. 4 shows the transportation cable 22, inclined at an angle alpha relative to the horizontal, and attached to one of the anchor chains 10. The angle alpha may, for example be greater than 5 degrees, and may, for example, be less than 20 degrees. However, other angles can also be used.

Also shown in FIG. 4 is a wear element 14, complete with hook ROV rigging 32 and crane ROV rigging 34 (described in the next paragraph). The cylindrical wear element 14 is typically two half shells 40 and 42 hinged together by a hinge mechanism (not shown) to allow the wear element 14 to be opened up and placed around the riser 8 by the second ROV 18 before being closed by the ROV 18. The half shells are locked by a ROV-operated locking device 44 after installation. The half-shells 40 and 42 can float upwards along riser 8 individually or attached together and develop a "train", or be fixed to the riser 8 at a static location. The purpose of the wear element 14 is to protect the outer skin of the riser 8, known as an outer sheath, to avoid puncturing and sea water ingress into the various steel layers in the annulus of the riser 8. Typically such wear occurs as a result of contact between the riser 8 and a guide-tube guiding the riser 8 and movement between the two caused by the environment (eg wind, waves and current).

FIG. 4 shows that the hook ROV rigging 32 is provided with a hook 46 for connection to the cable 22 by the first ROV 16. The hook 46 is connected to the wear element 14 by a chain 48 and securing cables 50. At the opposite end of the wear element 14, the crane ROV rigging 34 is provided with a metal loop, or chain link 52 for connection to a crane hook 54 provided on the crane wire 30. The loop 52 is connected to the wear element 14 by securing cables 56.

The transportation cable 22 may be inclined relative to the horizontal at substantially a fixed angle along the whole length of the cable 22 between the two supporting points 24 and 26.

In one embodiment the transportation cable 22 can have rather low tension giving large movement of the cable 22 horizontally, and this embodiment may have no stopper 36 on the cable 22 as the wear element 14 will find a "high-point" where further movement of the wear element 14 will stop.

The method described provides a time saving method to transport wear elements 14 to a ROV 18 working on the marine installation of wear elements without shutting down the platform 2. Hence potentially large and valuable production of oil and gas is secured by the method.

Embodiments may relate to transportation of wear elements to a ROV worksite without exposing the risers to the potential of damage by vessel impact.

Each feature disclosed or illustrated in the present specification may be incorporated in the invention, whether alone or in any appropriate combination with any other feature disclosed or illustrated herein.

The invention claimed is:

1. A marine installation arrangement for installing an item on a riser under the surface of a sea, the arrangement comprising:

a marine hydrocarbon platform including two anchor chains anchoring said marine platform to the seabed, said two anchor chains providing two supporting points;

a transportation cable extending between the two supporting points, said cable being inclined relative to the horizontal;

a first ROV arranged to mount said item on said cable at a first position; and a second ROV arranged to remove said item from said cable at a second position, and to install said item on said riser.

2. The arrangement as claimed in claim 1, wherein said cable is inclined at an angle of 5 to 20 degrees relative to the horizontal.

3. The arrangement as claimed in claim 2, wherein said cable is inclined relative to the horizontal at substantially a fixed angle along the whole length of the cable between said two supporting points.

4. The arrangement as claimed in claim 1, wherein said cable is inclined relative to the horizontal at substantially a fixed angle along the whole length of the cable between said two supporting points.

5. The arrangement as claimed in claim 1, wherein said first and second ROVs are connected to a vessel by umbilical cords.

6. A marine installation system comprising:

the marine installation arrangement as claimed in claim 1; and said item.

7. The system as claimed in claim 6, wherein said item is a wear element.

8. The system as claimed in claim 6, wherein said item comprises two portions which are hingedly connected together.

9. The system as claimed in claim 6, wherein said item is provided with crane rigging for connecting said item to a crane wire.

10. The system as claimed in claim 6, wherein said item is provided with hook rigging for connecting said item to said transportation cable.

11. The system as claimed in claim 10, wherein said hook rigging comprises a hook for connecting said item to said transportation wire.

12. The system as claimed in claim 6, wherein the overall density of said item is lower than the density of sea water.

13. The system as claimed in claim 12, wherein said item is provided with crane rigging for connecting said item to a crane wire, wherein said item is provided with hook rigging for connecting said item to said transportation cable, and wherein the overall density of said item, said crane rigging and said hook rigging is lower than the density of sea water.

14. A method of installing an item on a riser using the marine installation system as claimed in claim 6, said method comprising:

fixing said cable between said two supporting points;

using said first ROV to mount said item on said cable at said first position;

allowing said item to slide along said cable; and using said second ROV to remove said item from said cable at said second position, and to install said item on said riser, wherein said cable is inclined at an angle of 5 to 2.0 degrees relative to the horizontal.

15. The method as claimed in claim 14, wherein said item slides down said cable under the influence of gravity or slides up said cable as a result of buoyancy.

16. The method as claimed in claim 14, which further comprises lowering said item to said first ROV from a vessel on the surface of said sea.

17. The method as claimed in claim 16, which comprises lowering said item to said first ROV on a crane wire supported by a crane on said vessel.

* * * * *